US006622491B2

(12) United States Patent
Hofmann

(10) Patent No.: US 6,622,491 B2
(45) Date of Patent: Sep. 23, 2003

(54) PERIODICALLY OPERATING REFRIGERATION MACHINE

(75) Inventor: Albert Hofmann, Karlsruhe (DE)

(73) Assignee: Forschungszentrum Karlsruhe GmbH, Karlsruhe (DE)

( * ) Notice: Subject to any disclaimer, the term of this patent is extended or adjusted under 35 U.S.C. 154(b) by 0 days.

(21) Appl. No.: 10/194,262

(22) Filed: Jul. 15, 2002

(65) Prior Publication Data

US 2003/0019218 A1 Jan. 30, 2003

Related U.S. Application Data

(63) Continuation-in-part of application No. PCT/EP01/00124, filed on Jan. 8, 2001.

(30) Foreign Application Priority Data

Jan. 15, 2000 (DE) ..... 100 01 460

(51) Int. Cl.[7] ..... F25B 9/00
(52) U.S. Cl. ..... 62/6
(58) Field of Search ..... 62/6

(56) References Cited

U.S. PATENT DOCUMENTS 4,858,441 A 8/1989 Wheatley et al.
5,152,147 A * 10/1992 Saho et al. ..... 62/6
5,269,147 A 12/1993 Ishisaki et al.
5,481,878 A 1/1996 Shaowei
5,722,243 A 3/1998 Reeves
5,791,149 A * 8/1998 Dean ..... 62/6
5,927,081 A 7/1999 Li
6,374,617 B1 * 4/2002 Bonaquist et al. ..... 62/6
6,389,819 B1 * 5/2002 Zhu et al. ..... 62/6

OTHER PUBLICATIONS

Phase Shifting in pulse tube refrigerators, A. Hofmann, H. Pan, Cryogenics 39 (1999) 529–537.
Patent Abstracts of Japan Publ. No.—03194364.
Patent Abstracts of Japan Publ. No. 07019635.

* cited by examiner

*Primary Examiner*—William C. Doerrler
(74) *Attorney, Agent, or Firm*—Klaus J. Bach

(57) ABSTRACT

In a periodically operating refrigeration machine which includes a thermal performance amplifier based on the known pulse tube process, the thermal performance amplifier includes a compression arrangement with a first heat exchanger for transferring heat to the environment a regenerator, a second heat exchanger supplying heat to the performance amplifier, a pulse tube, and a third heat exchanger for removing heat which is disposed adjacent a pulse tube cooler. The pulse tube cooler also includes a regenerator, a heat exchanger and a pulse tube, another heat exchanger and an expander all sized for an optimal operation.

7 Claims, 6 Drawing Sheets

POINTER - REPRESENTATION OF THE VOLUME FLOWS (U) OF THE PRESSURE OSCILLATIONS (p) AT VARIOUS LOCATIONS. a) DIRECTLY DRIVEN PULS TUBE COOLER, b) SERIES ARRANGEMENT OF PULSE TUBE AMPLIFIER AND PULSE TUBE COOLER.
EXPLANATION OF THE INDICES: R: REGENERATOR, E: INLET, A: EXIT, PT: PULSE TUBE

Fig. 6a
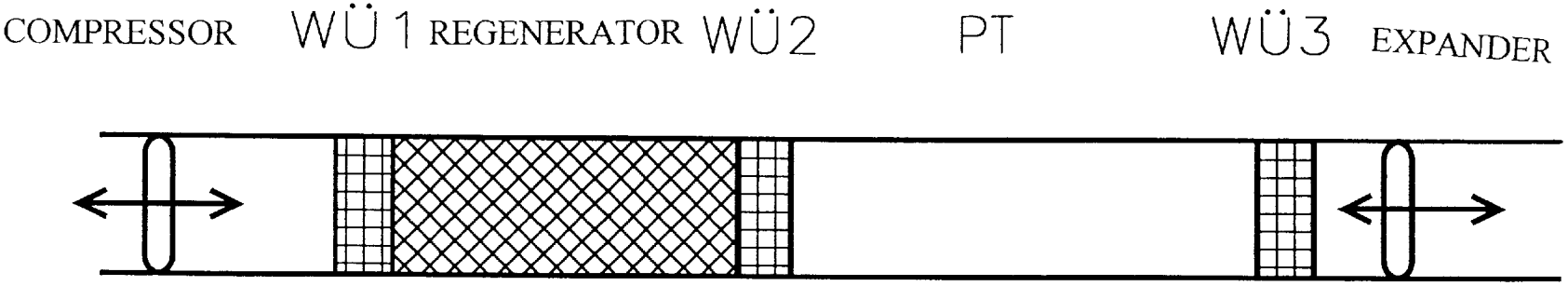
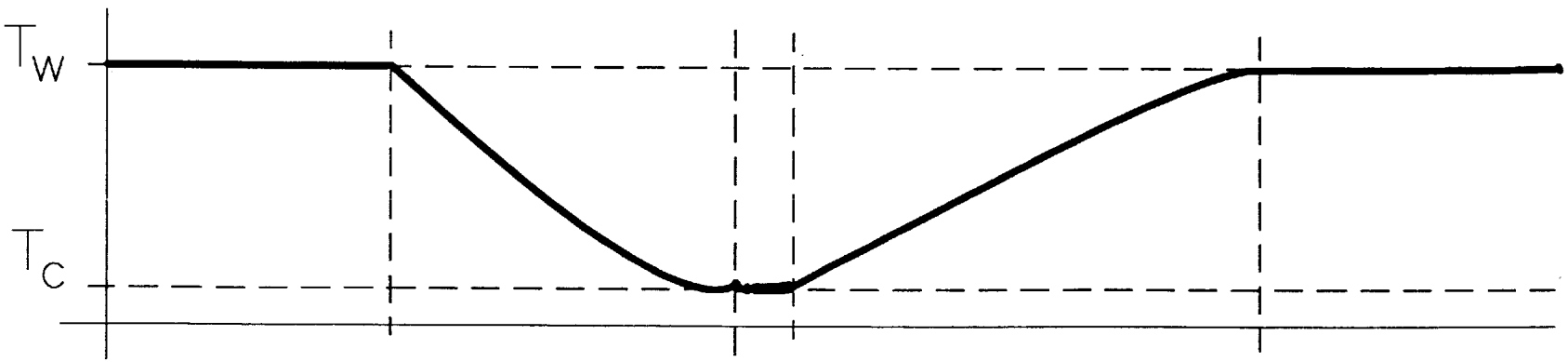
Fig 6b
Prior Art

PERIODICALLY OPERATING REFRIGERATION MACHINE

This is a Continuation-In-Part application of International application PCT/EP01/00124 filed Aug. 1, 2001 and claiming the priority of German application 100 01 460.7 filed Jan. 15, 2000.

BACKGROUND OF THE INVENTION

The invention relates to a periodically operating refrigeration machine, that is, to a thermal performance amplifier for such a machine and to a method of operating a refrigeration machine by a thermal cycle process.

It is well known to provide a refrigeration process operating according to the Stirling principle, which includes no moving mechanical parts in the cold section of the cycle. The cooler of such a machine comprises a compressor piston periodically operated at ambient temperature, a thermally isolated regenerator, a pulse tube which is also thermally insulated and which is provided at both ends with heat exchangers, and an expansion piston, which is also operated at ambient temperature. The pistons are so moved that the pulse tube experiences the following cycle:

Compression of the gas;

Moving the gas toward the expander;

Expansion of the gas;

Moving the gas toward the compressor.

A detailed analysis shows that a relatively large amount of energy is supplied to the compressor. A relatively small part thereof is re-gained in the expander. The difference is converted into heat which must be essentially removed in the area of the compressor (See also FIG. 6).

Such cooling cycles have been built in some differently modified ways. With single stage arrangements, the temperature can be reduced typically from room temperature to about 25° K [I, II]; with two-stage arrangements, temperatures of less than 4° K can be reached [III].

SUMMARY OF THE INVENTION

In a periodically operating refrigeration machine which includes a thermal performance amplifier based on the known pulse tube process, the thermal performance amplifier includes a compression arrangement with a first heat exchanger for transferring heat to the environment, a regenerator, a second heat exchanger supplying heat to the performance amplifier, a pulse tube, and a third heat exchanger disposed adjacent the pulse tube cooler for removing heat. The pulse tube cooler also includes a regenerator, a heat exchanger and a pulse tube, another heat exchanger and an expander, all sized for optimal operation.

The invention was arrived at by the following considerations:

If, in the heat exchanger between the regenerator and the pulse tube so much energy is added that no cooling but rather, heating above room temperature occurs, the energy to be removed at the expander is greater than the compression energy mechanically supplied to the system. A part of the heat added in the heat exchanger between the regenerator and the pulse tube and removed in the heat exchanger at the end of the pulse tube is converted to work and therefore results in an increase in the mechanical power.

The mechanical energy gained in this way is usable in the operation of a pulse tube cooler.

A refrigeration machine using this concept includes a thermal power amplifier and a pulse tube cooler arranged at the exit of the thermal power amplifier which, accordingly, are arranged in series.

The thermal performance amplifier comprises a compressor arrangement to which a first heat exchanger is connected which transfers heat to the environment. A regenerator is connected to the heat exchanger. At the other end, a second heat exchanger is provided by way of which heat is supplied to the performance amplifier. This heat exchanger is therefore termed a heater. The pulse tube of the power amplifier is connected to the heater and, at the opposite end, to a heat exchanger, which discharges heat from the pulse tube. The pulse tube cooler is connected to the last mentioned heat exchanger. In this arrangement, the last heat exchanger of the power amplifier is the first heat exchanger of the pulse tube cooler. Between the regenerator and the pulse tube of the pulse tube cooler, there is the heat exchanger, which forms the usable refrigeration zone. Finally, the pulse tube includes a last heat exchanger followed by an expansion device coupled thereto.

There are different operational variants of pulse tube coolers [I–III].

There are two variants with movable parts:

The Stirling process with a piston expander and the Stirling process with a passive expander, and there are two variants which have no movable parts:

The Gifford-McMahon operating system with a high and a low pressure reservoir, which are both connected to a regenerator, each by way of a supply line including a valve and a passive expander and finally the Gifford-McMahon-operating system with a compression device and with a controllable valve arranged in the communication line from the high and the low pressure reservoirs, the valve controlled expander, to the pulse tube.

The pulse tube amplifier may be heated electrically, but other heat sources such as solar heat or combustion heat can be utilized like with the Sterling motor. In this case, the cooler can be operated with a further reduced need for primary energy.

With the invention, the following advantages are achieved:

The efficiency is improved so that less primary energy is consumed for the same refrigeration effect;

The manufacture of the cooler is relatively inexpensive;

in comparison with a mechanical compressor, a pulse tube amplifier can be manufactured very inexpensively, the additional expenses are compensated for by the need for only a small compressor;

the operating costs are relatively low;

maintenance costs are low, the pulse tube amplifier itself needs no maintenance. The additional components needed for the pulse tube cooler require only relatively small components such as a compressor and valves which need to be serviced or exchanged periodically, but they are relatively small and therefore relatively inexpensive.

Below, the invention will be described in greater detail on the basis of the accompanying drawings:

BRIEF DESCRIPTION OF THE DRAWINGS

FIGS. 6*a* and 6*b* show the operation principle of the pulse tube cooler and the temperature along the pulse tube.

DESCRIPTION OF EMBODIMENTS

First, the operation principle of a pulse tube cooler with its four phases of a period is shortly described on the basis of FIGS. 6*a* and 6*b*.

The compressor 1 and the expander 12 are so operated that the following cycle occurs in the pulse tube:

compression of the gas in a compressor 1 at the beginning of the pulse tube PT.

moving of the compressed gas toward the expander 12 at the end of the pulse tube PT by a length $\Delta_1$ which is less than the full length of the pulse tube. Heat is removed from the compressed gas flow in the heat exchanger WU3 at the end of the pulse tube.

expansion of the gas by the expander 30.

The whole gas column cools down, at the left end below the temperature of the respective heat exchanger WU1.

Movement of the gas toward the compressor 1.

This results in cooling at the left heat exchanger WU1 or heat has to be added in the heat exchanger WU1 if this heat exchanger is to be operated at constant temperature.

Figures 1A, 1B:
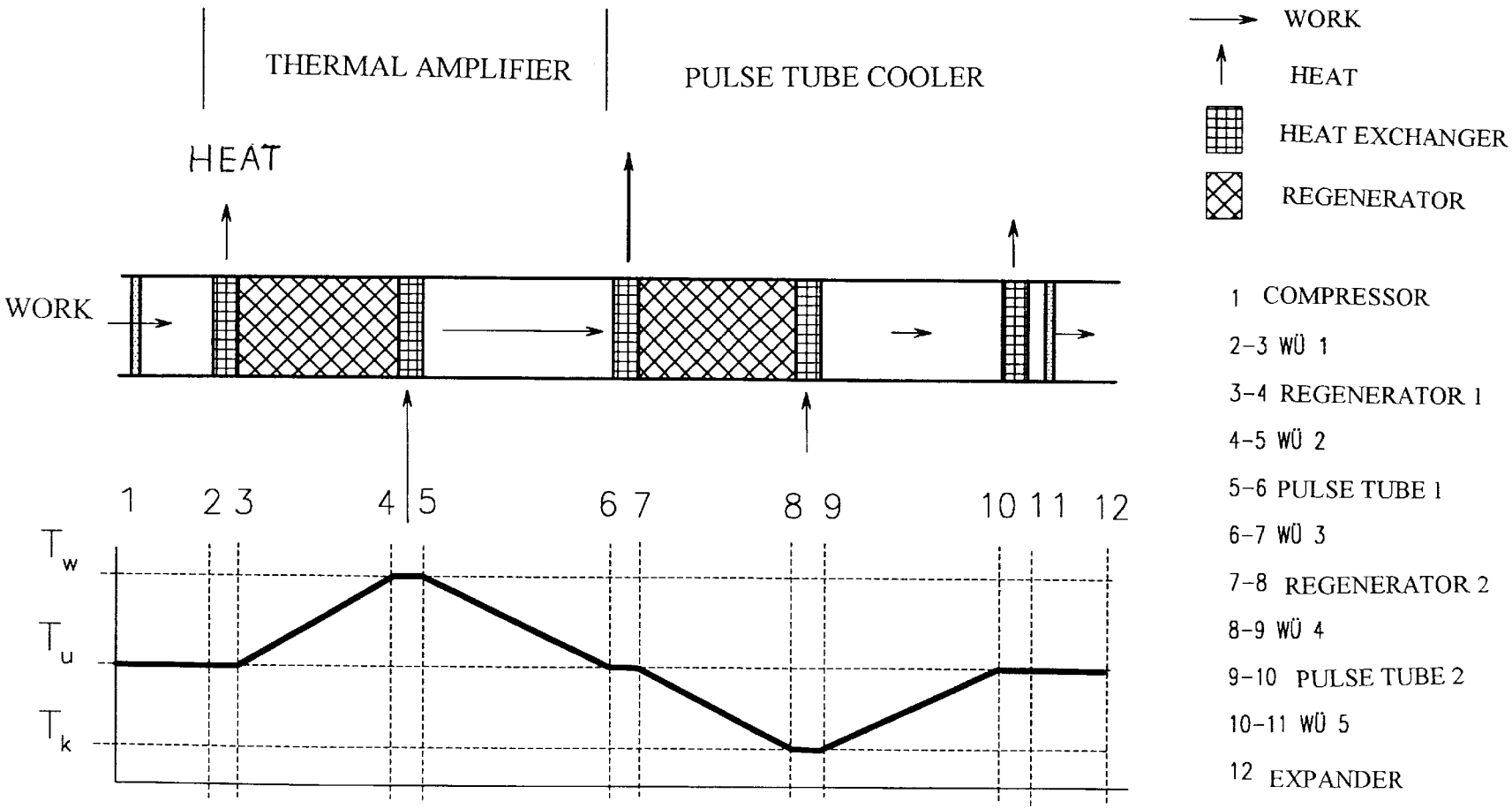
FIG. 1*a* shows schematically a refrigeration machine design in a series-arrangement of a thermal amplifier and a pulse tube cooler.
FIG. 1*b* shows the temperature along the series arrangement.
Figure 2:
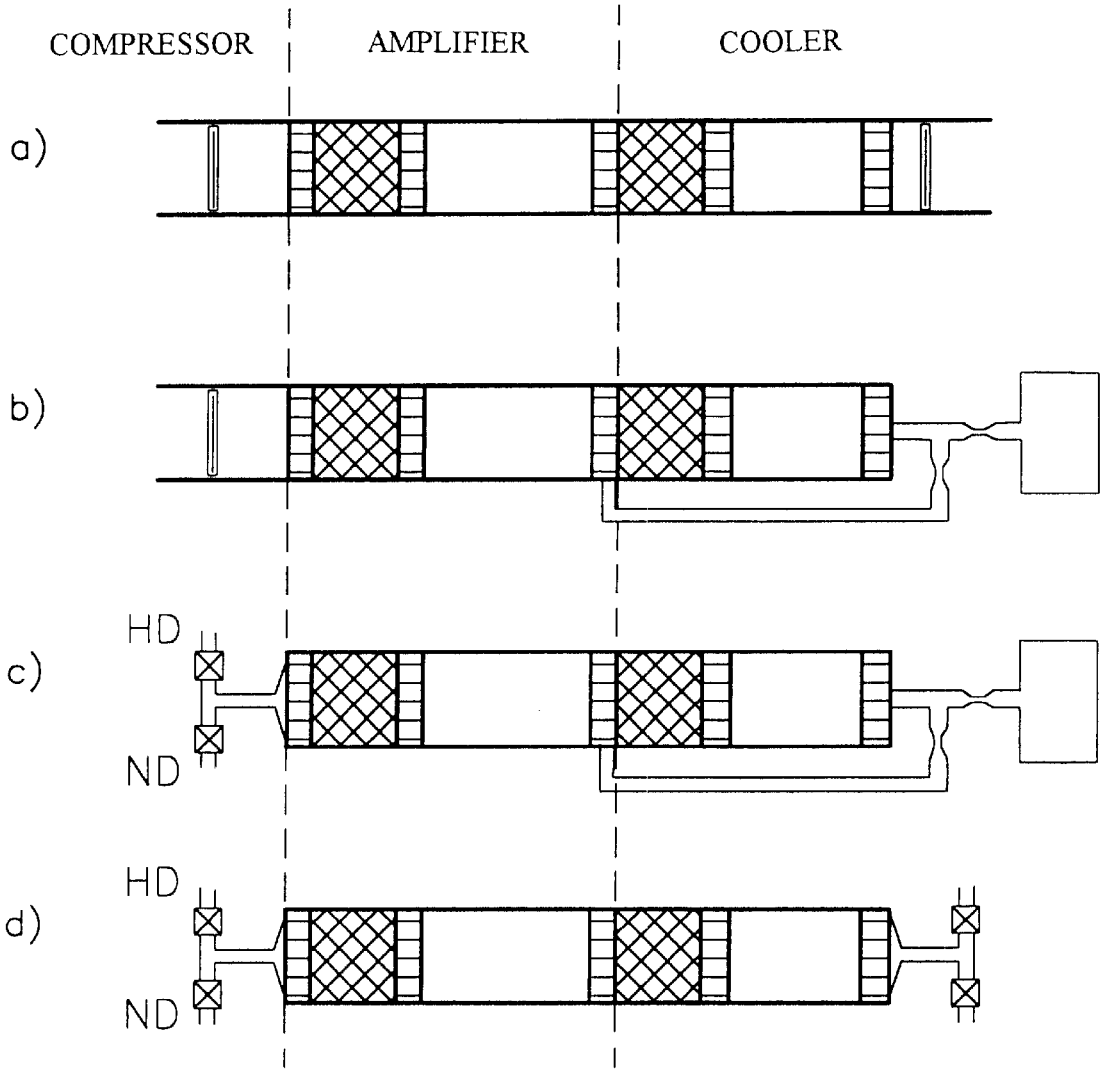
FIG. 2*a* shows an embodiment using a Sterling-type machine with double piston.
FIG. 2*b* shows an embodiment using a Sterling-type machine with a single piston and a double inlet phase shifter.
FIG. 2*c* shows an arrangement of the Gifford-McMahon type with a double inlet phase shifter.
FIG. 2*d* shows a Gifford-McMahon type arrangement with an active phase shifter.

The pulse tube cooler can be operated in different ways. Respective operating schemes are shown in FIGS. 2*a* to 2*d* in combination with a thermal amplifier. This scheme according to FIGS. 2*a* and 2*b* is based on the availability of a suitable piston compressor C, c' for driving the amplifier. In accordance with the known Sterling process, work is regained during expansion. In accordance with the principle used in FIGS. 2*c* and 2*d*, the gas flow supplied to the amplifier is controlled by periodically operated valves V1 and V2. The pressurized gas is supplied to the tube from a high pressure container HD, HD' (pressurized gas reservoir); this pressure is released by connection to a low pressure container ND, ND', which is similar to the operation with a Gifford-McMahon (GM) cooler. The GM operation is less efficient than the Sterling operation but it has the advantage that relatively inexpensive compressors can be used. The same is true for the pulse tube amplifier and for the series arrangement of the two units. FIGS. 1*a* and 1*b* show schematically the combination of the thermal power amplifier and the pulse tube cooler.

Below, an exemplary embodiment of a periodically operating refrigeration machine, which includes a series arrangement of a thermal performance amplifier and a pulse tube cooler operated thereby will be described.

Since the thermal performance amplifier which is also called a compressor or pulse tube compressor, operates like a pulse tube cooler, both systems, the performance amplifier and the pulse tube cooler can be handled in the same way. A known calculation process [IV] provides for good consistency with experimental values. In a typical case, a cooler is considered which requires at the regeneration input an operating flow ("pV performance) of 1000 W. With a 2 Hz pulse frequency, a harmonically pulsating gas volume flow with peak values for $U_s$=4.8 l/s and a pressure $p_s$=5.7 bar with a phase difference of 45° is required. In a valve-controlled operating mode, the pulsations are not harmonic. It has been found, however, that the calculation model provides for a good approximation even under these circumstances. In a GM operating mode, the "pV-performance" is provided by a compressor having about 6000 W electric power input. It operates at a compressor ratio of about 1.9 at 18 bar medium pressure. For an optimally adapted pulse tube cooler, the calculation procedure indicates a cooling performance of about 110 W at 50° K cold temperature and 300° K. ambient temperature.

In the calculation, harmonic, that is, sine-like pulses of pressure and volume flow are assumed. In the optimized system, the relationship between pressure p and volume flow V as shown in the pointer/phase diagram of FIG. 3*a* for the various locations such as regeneration inlet, RE, pulse tube entrance, PTE in the pulse tube at the end adjacent the compressor is ahead of the pressure $P_{PT}$ in the pulse tube by about 30°, whereas the gas flow $U_{PT,A}$ at the opposite end trails the pressure by about 45°. Similar operating condition should be present at a pulse tube amplifier if it is designed for optimal energy conversion.

Figure 3B:
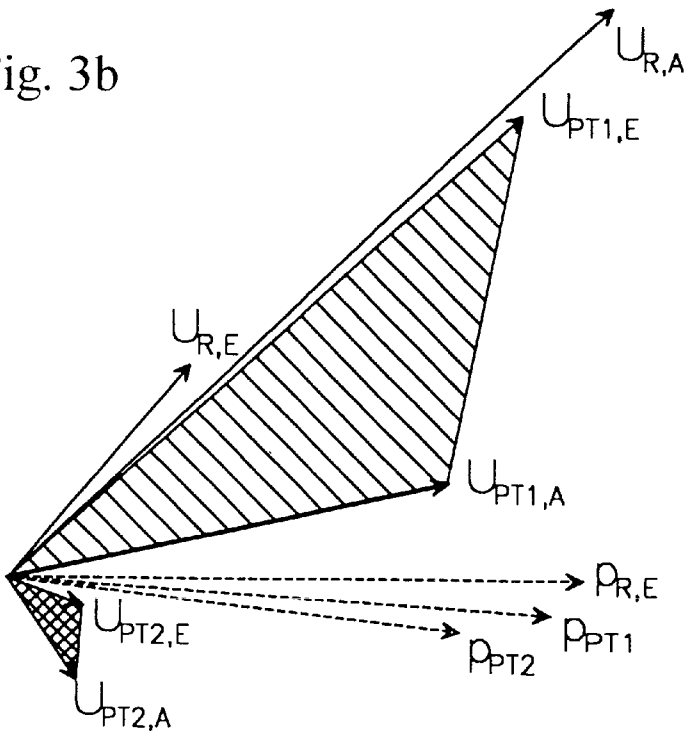
FIG. 3*b* shows a phase diagram of the oscillation of the pressure and the volume flow for a refrigeration machine with a series arrangement of the pulse tube amplifier and the pule tube cooler.
Figure 3A:
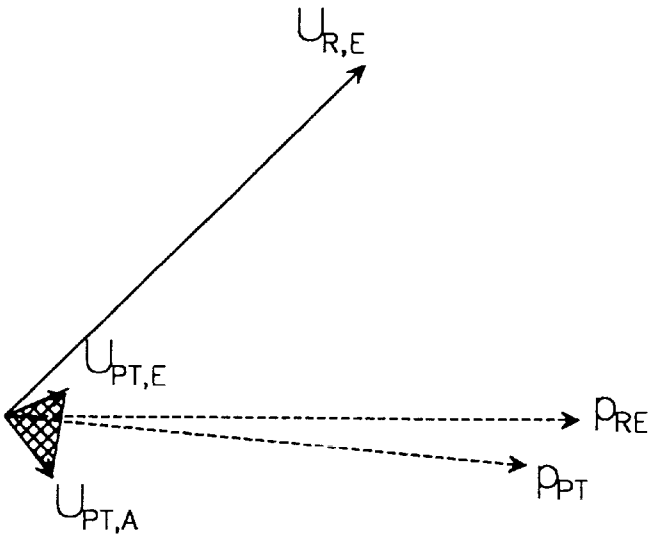
FIG. 3*a* shows a phase diagram of the oscillation of pressure and the volume flow for an optimized pulse tube cooler.

However, if now the pulse tube amplifier (compressor 1) and the pulse tube cooler 2 are arranged in series as it is the case with the arrangement according to the invention shown in FIGS. 1*a*, 1*b*, 2*a*–2*d* and 4, the phase shifts add up as indicated in FIG. 3*b*. In the pulse tube of the pulse tube- or performance amplifier 1 both volume flow pointers $U_{PT1,E}$ and $U_{PT1,A}$ are ahead of the pressure $P_{PT1}$ and in the cooler 2, the volume flows $U_{PT2,E}$ and $U_{PT2,A}$ trail the pressure $P_{PT2}$. Supplementing this, in FIG. 3*b*, the pointers of the pressure and volume flow oscillation are indicated also for other locations. $U_{R,E}$ designates for example the volume flows fed to the regenerator of the amplifier at room temperature. The volume flow $U_{R,A}$ present at the heated end of this regenerator has a greater length because of the thermal expansion of the gas, and a small rotation as a result of the void volume in the regenerator. The difference between $U_{R,A}$ and $U_{PT1,E}$, the gas stream present at the hot end of the pulse tube, occurs in the passages of the gas through the heater unit. Correspondingly the pointers $P_{R,E}$, $P_{PT1}$ and $P_{PT2}$ designate the pressures in the pulse tube of the amplifier unit and in the pulse tube of the cooler unit at the room temperature end of the regenerator which belongs to the amplifier.

Both components are not operated under the respective optimal conditions. As a result, the efficiency of the pulse tube cooling is detrimentally affected when compared with an operation with direct compressor connections. By a modification of the dimensions, the detrimental effects can be reduced however to such an extend than an overall gain is achieved.

For example, with a pulse tube cooler operated in a conventional way according to the GM operating system with a 6000 W electric drive for the compressor, a cooling performance of 110 W at 50° K can be achieved. Upon use of a pulse tube amplifier with 1000° K medium temperature in the area of heating, the compressor power requirements are reduced by about 50%; however a heat input of 1700 W at 1000° K must be supplied. Consequently, the total electric drive input power is reduced from 6000 W to 4700 W, 300) W at the compressor and 1700 W at the heater.

Figure 5:
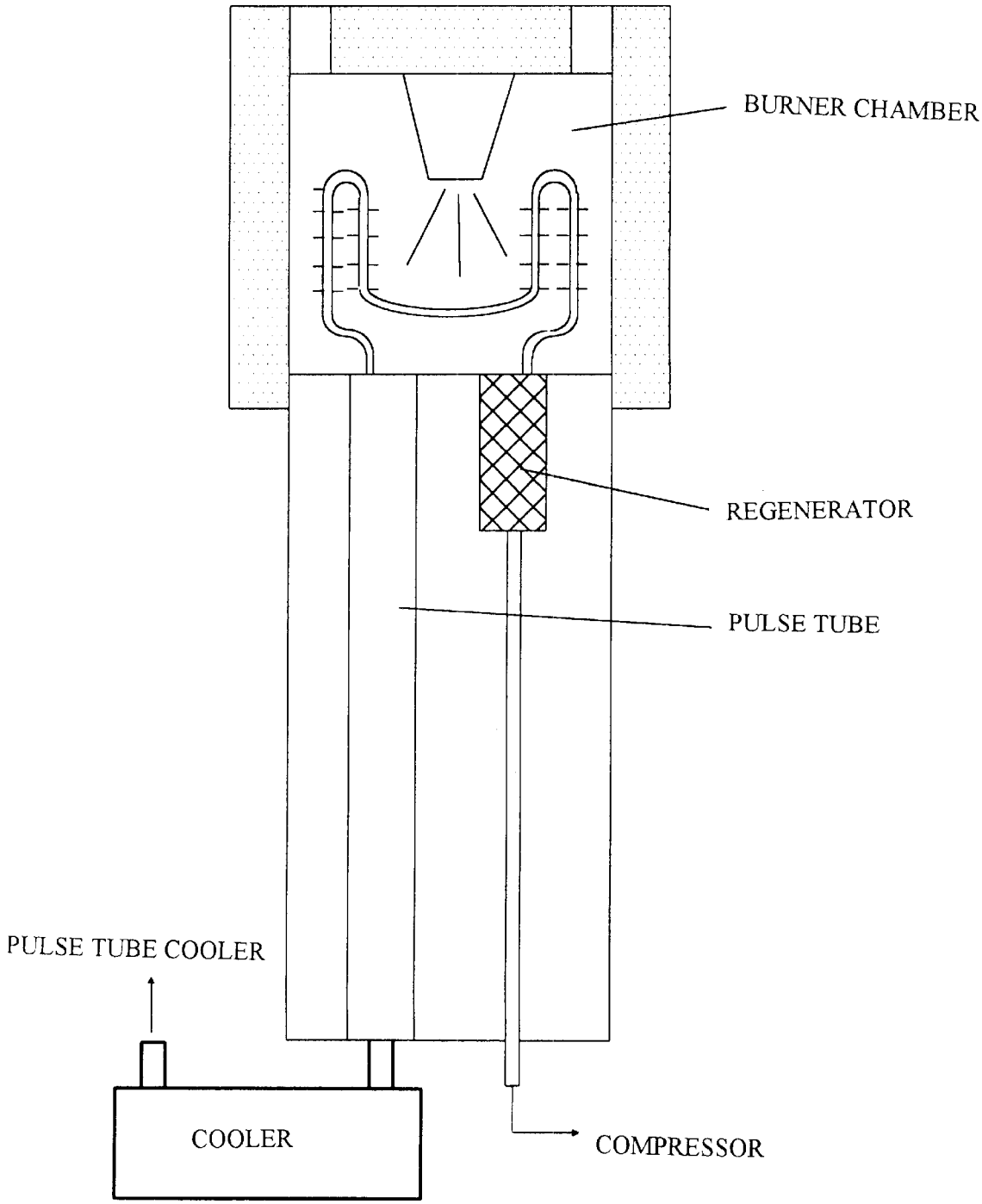
FIG. 5 shows the heater in the form of a combustion chamber heating system.

The result becomes even more advantageous if materials with higher temperature resistance are used or if the heat is not supplied by electric heating means, but by a gas combustion chamber 50 as shown for example in FIG. 5 in a schematic way. The pipe connection 52 between the exit area of the regenerator 51 and the inlet 53 of the pulse tube is heated by a gas flow. The pulse tube cooler 55 is connected to the outlet of the recuperation cooler 54.

Figure 4:
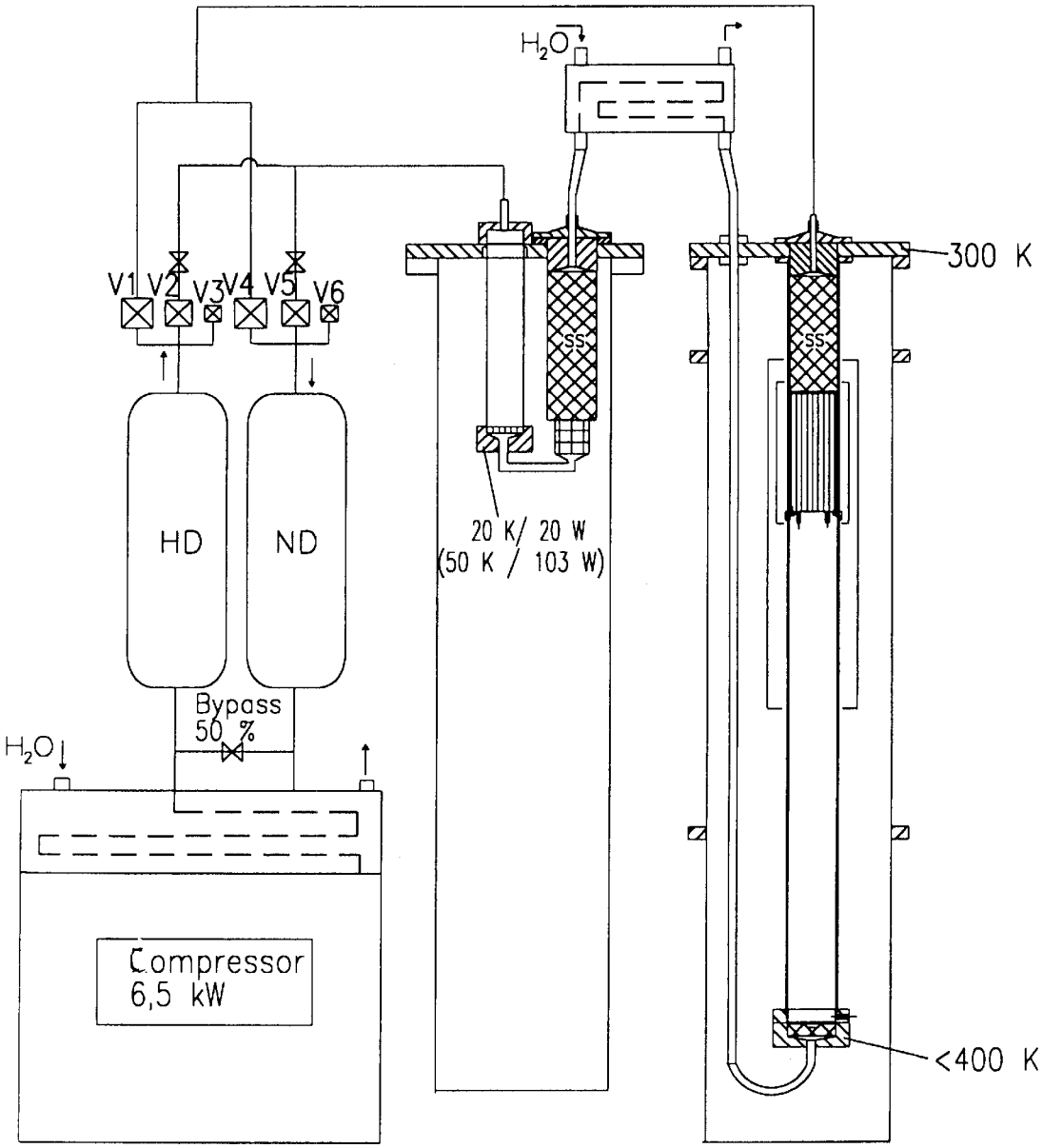
FIG. 4 shows the arrangement of the refrigeration machine with a valve operated thermal amplifier.

A practical embodiment of a cooler with the performance data mentioned above is shown for example in FIG. 4. At the left side of the figure, the compressor 60 is shown with high- and low pressure storage containers HD and ND and with the alternately operated valves V1, V2, V3, v4, V5, V6, which may be rotary valves or magnetically operated valves. The center unit represents the one-stage pulse tube cooler 70 to be operated and the right unit shows the performance and pulse tube amplifier 80 adapted to the pulsed tube cooler. The regenerator 81 of the pulse tube amplifier 80 is in its design similar to the cooler 82; however the pore size is adapted to the higher temperature range. A direct heating structure may be provided which may be a ceramic body supporting a heating coil in an essentially conventional manner. The pulse tube is optimized with regard to its length and diameter such that at its lower end a temperature only slightly above ambient temperature (300° K. ΔT) is present and that the phase relationship between pressure and gas flow is adapted to the requirements of the series arrangement. In the following water-cooled heat exchanger 83 the gas, which has been heated before at a high temperature, is cooled down to ambient temperature. A similar cooling occurs in the cooler 62. Therefore, the heat exchanger 83 arranged between the pulse tube amplifier 80 and the pulse tube cooler may be of similar design as the heat exchanger 62 integrated into the compressor, which is a plate-type heat exchanger. The linear alignment of the pulse tube performance amplifier of FIG. 4 is based on practical considerations. Pulse tube amplifier 80 and cooler 83 are shown on the same scale. The essential dimensions and operating parameters are listed in table 1.

TABLE 1

| Parameters of pulse tube amplifier | |
|---|---|
| Frequency ($H_2$) | 2 |
| Pressure (bar) | |
| Min. | 12.4 |
| Max | 23.6 |
| Average mass flow (g/s) | 5 |
| Regenerator | |
| Length (mm) | 140 |
| Diameter (mm) | 60 |
| Heater | |
| Length (mm) | 140 |
| Diameter (mm) | 60 |
| Pulse Tube | |
| Length (mm) | 600 |
| Diameter (mm) | 60 |

The regenerator 81 consists of stacked 100 mesh SS, with 62 mm diameter, 2 mm thick. Adjacent thereto is a heat exchanger 82 in the form of a heater, which consumes 1700 W and generates 1000° K. It has an internal diameter of 55.2 mm and a length of 140 mm. The void space is 50%. The pulse tube 85 with the above dimensions follows. It has a wall thickness of 2 mm and consists of high temperature steel 1.4961. At the pulse tube exit, there is a flow equalizer 86 consisting of 200 mesh SS, which is about 15 mm thick. The heater is enclosed in a first radiation shield 87. Another radiation shield 88 is disposed around the first radiation shield 87, about a third of the regenerator and about one third of the pulse tube.

If other than electric heaters are used for the heater, the heat must be generated in a combustion chamber outside the gas space or a collector space of a solar heater and must be transferred to the operating gas. The problem is the same for Stirling engines. The solutions developed herefor, with which, at the present time, operating temperatures of up to about 1000° K. can be reached, can be adapted with only small modifications. In an analogous manner, the pulse tube amplifier according to the schematic representation of FIG. 5 can be operated with a gas or oil burner. The U-shaped arrangement of regenerator 51 and pulse tube 54 as shown in the drawings has been found to be advantageous. The warmer gas of the regenerator and of the pulse tube 51 are on top so that no heat is conducted away by natural convection.

LITERATURE

I. S. Wild: *Untersuchung ein-und mehrstufiger Pulsrohrkuhler,* Fortschritt-Berichte VDI, Reihe 19, Nr. 105, VDI-Verlag Dusseldorf 1997, ISBN 3-18-310519-5

II. J. Blaurock, R. Hackenberger, P. Seidel, and M. Thurk. Compact Four-Valve Pulse Tube Refrigerator in Coaxial Configuration. Proc. 8$^{th}$ Int. Cryocooler Conf, Vail (USA) 1994, p . . . .

III. Wang, G. Thummes, and C. Heiden: *Experimental Study of Staging Method for Two-Stage Pulse Tube Refrigerators for Liquid Helium Temperatures*, Cryogenics Vol. 37 (1997), p. 159–164

IV. Hofmann and S. Wild: *Analysis of o two-stage pulse tube cooler by modeling with thermoacoustic theory*. Proc. 10$^{th}$ Int. Cryocooler Conf., May 26–28, 1998, Monterey, Ca. (USA)

V. H. Carlson: 10 kW Hermetic Stirling Engine for Stationary Application, 6$^{th}$ International Stirling Engine Conference, Eindhoven (NL), May 26–28, 1993 (Paper ISEC-93086)

What is claimed is:

1. A periodically operating refrigeration machine, comprising: a thermal performance amplifier based on a pulse tube process and a pulse tube cooler arranged in series with a heat exchanger operating as a cooler, said thermal performance amplifier including a compressor arrangement for compressing gas, a first heat exchanger for removing heat from the gas compressed by said compressor arrangement, a regenerator arranged in series with said first heat exchanger, a second heat exchanger arranged in series with said regenerator for supplying heat to the gas in said performance amplifier, a pulse tube arranged in series with said second heat exchanger, said pulse tube comprising a third heat exchanger arranged in said pulse tube for removing heat therefrom, (pulse tube cooler) a fourth heat exchanger, a fifth heat exchanger and an expander all arranged in series in said pulse tube, said refrigeration machine being a Stirling-type machine including in said compressor arrangement a compressor piston and as expander a double inlet phase shifter in the form of pipe connection with a variable cross-section from the third heat exchanger to the fifth heat exchanger and a pipe connection with a variable cross-section between the fifth heat exchanger and an expansion container.

2. A periodically operating refrigeration machine comprising: a thermal performance amplifier based on a pulse tube process and a pulse tube cooler arranged in series with a heat exchanger operating as a cooler, said thermal performance amplifier including a compressor arrangement for compressing gas, a first heat exchanger for removing heat from the gas compressed by said compressor arrangement, a regenerator arranged in series with said first heat exchanger, a second heat exchanger arranged in series with said regenerator for supplying heat to the gas in said performance amplifier, a pulse tube arranged in series with said second heat exchanger, said pulse tube comprising a third heat exchanger arranged in said pulse tube for removing heat therefrom, a fourth heat exchanger, a fifth heat exchanger and an expander all arranged in series in said pulse tube, said refrigeration machine being a Gifford-McMahon (GM) type machine with a valve-controlled line extending from a high pressure reservoir to the GM machine and a valve controlled line extending between a low pressure reservoir and said machine and said expander being a double inlet phase shifter formed by a variable cross-section line connection from the third heat exchanger to the fifth heat exchanger and a variable cross-section line connection between the fifth heat exchanger and an expansion container.

3. A periodically operating refrigeration machine according to claim 1, wherein said compressor arrangement includes a valve-controlled line from a high pressure reservoir and said expander comprises a valve controlled supply line to the high pressure reservoir and a valve controlled line to a low pressure reservoir (four-valve arrangement).

4. A periodically operating refrigeration machine according to claim 1, wherein a heat source for the second heat exchanger is installed directly in the second heat exchanger.

5. A periodically operating refrigeration machine according to claim 1, wherein a heat source for the second heat exchanger is disposed outside the performance amplifier and is disposed in good heat transfer relation with the second heat exchanger for transferring the heat generated in the heat source to the second heat exchanger.

6. A periodically operating refrigeration machine according to claim 2, wherein a heat source for the second heat exchanger is installed directly in the second heat exchanger.

7. A periodically operating refrigeration machine according to claim 2, wherein a heat source for the second heat exchanger is disposed outside the performance amplifier and is disposed in good heat transfer relation with the second heat exchanger for transferring the heat generated in the heat source to the second heat exchanger.

* * * * *